US005531382A

United States Patent [19]

Buckley et al.

[11] Patent Number: 5,531,382

[45] Date of Patent: Jul. 2, 1996

[54] VALVE ARRANGEMENT

[75] Inventors: Paul Buckley; Christopher Wood, both of Kent, England

[73] Assignee: Lucas Industries Public Limited Company, Solihull

[21] Appl. No.: 314,662

[22] Filed: Sep. 29, 1994

[30] Foreign Application Priority Data

Oct. 8, 1993 [GB] United Kingdom ..... 9320783

[51] Int. Cl.[6] ..... F02M 51/04

[52] U.S. Cl. ..... 239/124; 239/533.9

[58] Field of Search ..... 239/96, 124–127, 239/585.1–585.5, 88–94, 582; 251/38, 39

[56] References Cited

U.S. PATENT DOCUMENTS 2,496,553 2/1950 Littlefield ..... 251/38 X
4,129,254 12/1978 Bader ..... 239/96
4,674,688 6/1987 Kaneska ..... 239/96 X
5,042,718 8/1991 Bergmann et al. ..... 239/88

FOREIGN PATENT DOCUMENTS 1606728 11/1990 U.S.S.R. ..... 239/96

*Primary Examiner*—Kevin P. Weldon
*Attorney, Agent, or Firm*—Cesari and McKenna

[57] ABSTRACT

A fuel injection nozzle has a valve member engageable with a seating to prevent fuel flow through an outlet orifice. The valve member is engaged by the narrower end of a stepped piston member the surface of which remote from the valve member is subjected to fuel under pressure to bias the valve member into engagement with the seating. A tubular valve element the interior of which is connected to a drain, is engageable with the surface but can be moved away from the surface to lower the pressure applied to the surface. The valve member lifts away from the seating when the pressure applied to the surface is reduced by fuel pressure acting on a further surface defined on the valve member. The valve element is connected to the armature of a solenoid.

6 Claims, 2 Drawing Sheets

VALVE ARRANGEMENT

This invention relates to electromagnetically operable valves including a valve member which is movable between first and second settings and an electromagnetic device having an output member which is coupled to the valve member and which when supplied with electric current moves the valve member from the first setting to the second setting, the valve including biasing means operable to return the valve member to the first setting when the supply of electric current is discontinued.

Such valves are well known in the art and can be used to control for example, the amount of fuel which is supplied to a combustion space of a compression ignition engine. Difficulties arise when the amount of fuel which needs to be supplied to the engine is reduced and it is possible that the amount of fuel which is supplied to the engine during the minimum cycle time of the valve is greater than is required. By minimum cycle time is meant the minimum time required for the valve member to move from the first to the second setting and back to the first setting. In such situations it is known in multi-cylinder engines to stop the flow of fuel to one or more of the engine combustion spaces so that the amount of fuel which is supplied to the remaining combustion spaces can be increased so that the valve or valves can operate for a period which is longer than the minimum cycle time.

The object of the present invention is to provide an electromagnetically operable valve in an improved form.

According to the invention an electromagnetically operable valve of the kind specified includes a valve element movable between first and second positions, the valve element moving under its inertia to its second position a predetermined time after and in response to, the movement of the valve member to its second setting, the valve element returning towards its first position after a second predetermined time.

An example of an electromagnetically operable valve in accordance with the invention will now be described with reference to the accompanying diagrams in which:-

Figure 1:
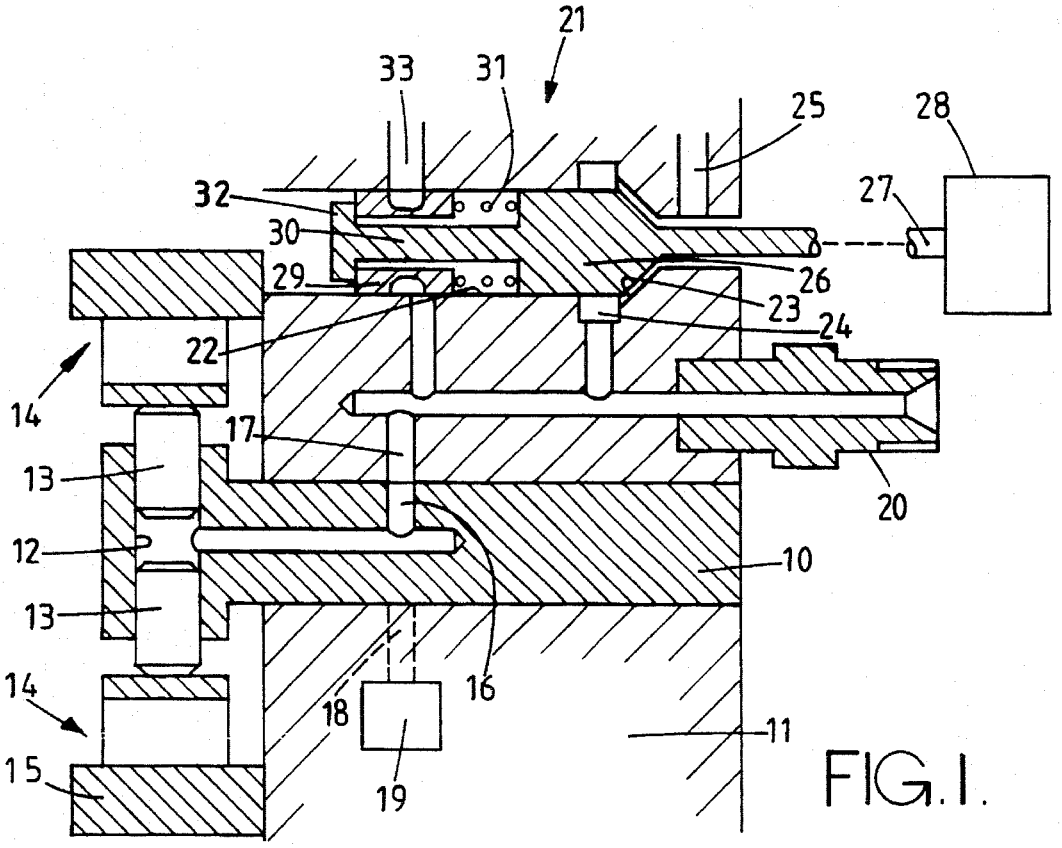
Figure 2:
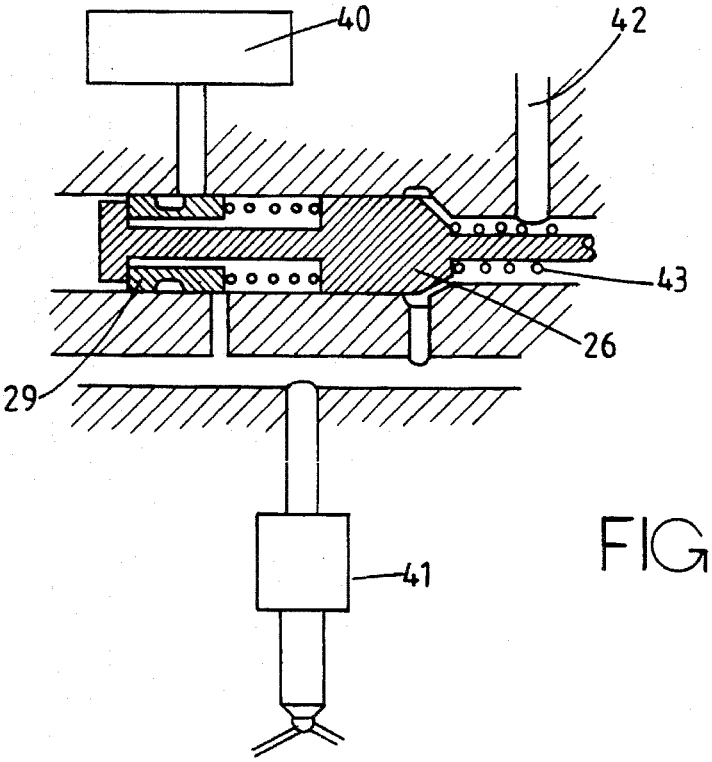
Figure 3:
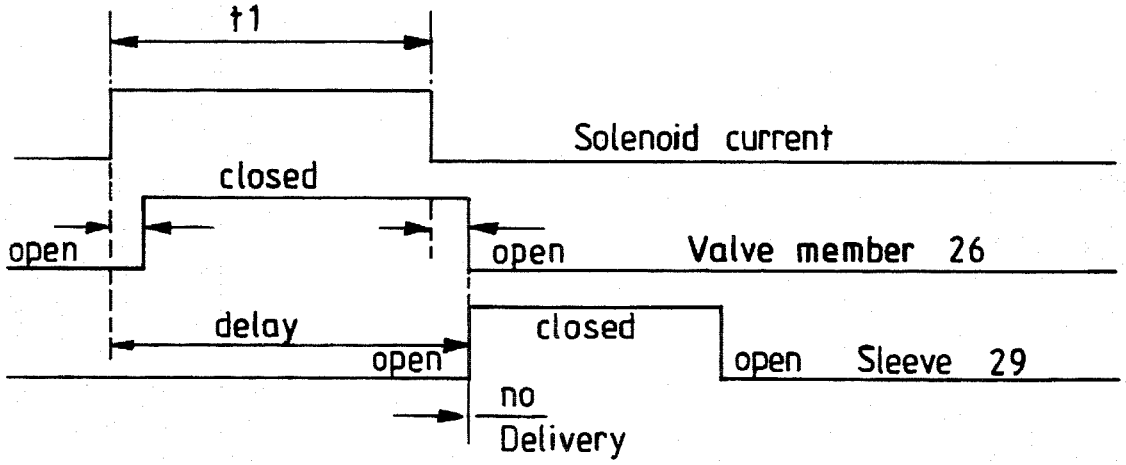
Figure 4:
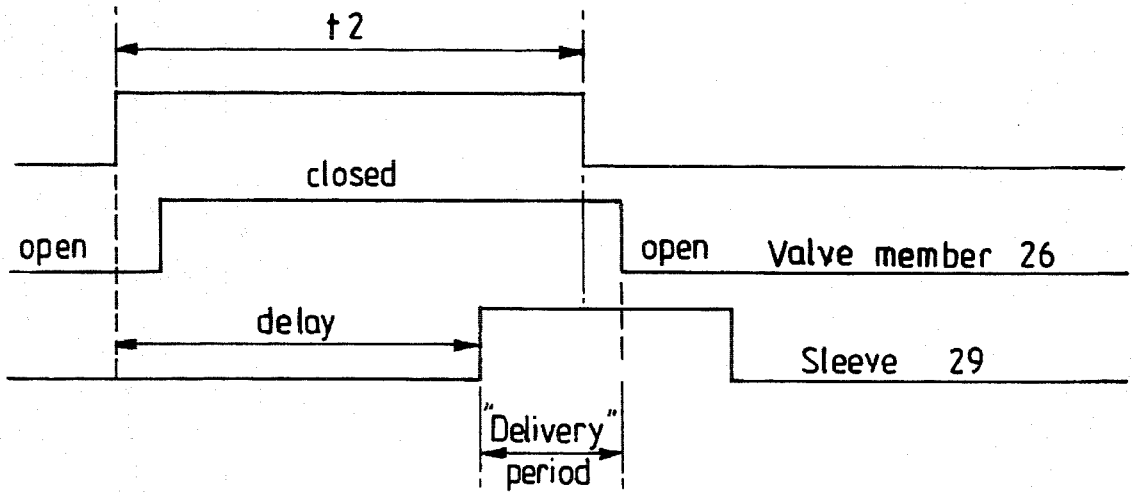

FIG. 1 shows a rotary distributor type pumping apparatus incorporating one example of the valve, FIG. 2 shows an accumulator type fuel system for supplying fuel to an injection nozzle of an engine, and FIG. 3 and 4 are timing diagrams appropriate to the valves seen in FIGS. 1 and 2.

Referring to FIG. 1 of the drawings the pumping apparatus includes a rotary distributor member 10 which is mounted within a surrounding body 11. The distributor member is driven in timed relationship with an associated engine through a drive shaft not shown.

Formed in the distributor member is a transverse bore 12 in which is mounted a pair of pumping plungers 13 and at their outer ends the plungers engage cam followers 14 respectively which engage with the internal peripheral surface of an annular cam ring 15. Formed on the internal surface of the cam ring are cam lobes, which as the distributor member rotates impart inward movement to the pumping plungers to expel fuel from the bore 12. The bore 12 communicates with an axially disposed passage to which is connected a radial passage 16. The passage 16 is arranged to register in turn with alternately arranged outlet ports 17 and inlet ports 18 formed in the body 11, only one of each port is shown in the drawing. The inlet ports 18 communicate with a source 19 of fuel under pressure and the outlet ports 17 communicate with outlets 20 respectively which are connected to the injection nozzles of the associated engine.

During inward movement of the pumping plungers the passage 16 is in register with an outlet port 17 so that fuel can be delivered to the engine and during further rotation of the distributor member the passage 16 moves out of register with an outlet port into register with an inlet port 18 so that a fresh supply of fuel can be supplied to the bore 12 to effect outward movement of the plungers 13.

In order to control the amount of fuel which is supplied to the associated engine and also the instant during the inward movement at which fuel delivery commences, there is provided a control valve which is generally indicated at 21.

The control valve includes a bore 22 at one end of which is defined a seating 23 and adjacent the upstream side of the seating is an annular gallery 24 which is connected to the outlet port 17. Downstream of the seating there is provided a passage 25 which is connected to a drain. Slidable in the bore 22 is a valve member 26 which is shaped for engagement with the seating 23 and which has an extension which is coupled to the output member 27 of an electromagnetic actuator 28 which includes an electrical winding to which power can be supplied by a control system. Conveniently the output member is the armature of the actuator. A spring biases the valve member and armature to the position shown in the drawing in which the valve member is spaced from the seating 23. Such a spring is shown at 43 in FIG. 2.

A valve element is provided and this is in the form of a sleeve 29 which is slidable in the bore 22 and which is loosely located about a stem 30 integral with the valve member. Interposed between the sleeve and a reaction surface on the valve member is a light coiled compression spring 31 which urges the sleeve into engagement with an abutment 32 mounted on the stem 30. The sleeve is provided with a peripheral groove which is in constant communication with the outlet port 17 and the groove in the position as shown, is in communication with a passage 33 which communicates with the drain.

As shown in FIG. 1 the valve member 26 is in the open position that is to say in its so called first setting and the sleeve 29 is in its so called first position in which the outlet port 17 is in communication with the passage 33. As the plungers move inwardly therefore fuel instead of flowing through the outlet 20, will flow along the two open flow paths controlled by the valve member and sleeve. When delivery of fuel to the associated engine is required the winding of the actuator 28 is energised and the valve member 26 will move to its second setting in which it is in engagement with the seating 23. The flow of fuel through the passage 25 is therefore halted. However, even though the sleeve 29 will have moved by the same amount as the valve member, the circumferential groove remains in communication with the passage 33 so that fuel continues to spill through this passage. The inertia of the sleeve which is gained during the rapid movement of the valve member into engagement with the seating, causes the sleeve to continue to move, such movement being against the action of the spring 31. Eventually the sleeve reaches its so called second position in which the groove is out of communication with the passage 33. Only when this takes place is spillage of fuel from the bore 12 halted so that fuel flow can take place to the associated engine. The movement of the sleeve due to inertia will eventually cease and the sleeve will start to return under the action of the spring 31 and if this process is allowed to take place without de-energising the winding of the actuator, as soon as the groove in the sleeve uncovers to the passage 33, fuel will again be spilled from the bore so that the delivery of fuel to the associated engine will cease.

The period of time during which the groove is out of communication with the passage 33 determines the maximum amount of fuel which can be supplied to the associated engine. If however the winding of the actuator 28 is de-energised before the sleeve has completed its movement the valve member 26 will start to move towards its first setting and as soon as it moves away from the seating, fuel is allowed to spill to the passage 25.

As shown in FIG. 1 a control valve 21 would be required to determine the fuel flow through each outlet 20. In practice only one such valve would be provided and the outlets 20 would receive fuel in turn by means of a distribution passage formed in the distributor member 10 and arranged to communicate with angularly spaced ports opening onto the periphery of the distributor member at angularly spaced positions and communicating with the outlets 20 respectively. The distribution passage would be in constant communication with each of the outlet ports 17.

Considering now FIGS. 3 and 4. In FIG. 3 the upper graph shows the current which flows in the winding of the solenoid of the actuator and the two lower graphs show the movement of the valve member 26 and the sleeve 29 respectively. It will be seen that the movement of the valve member 26 to the closed position takes place shortly after the commencement of current flow in the winding and it moves to the open position shortly after cessation of current flow. The movement of the sleeve from its open position to its closed position is achieved after a delay period and it remains in the closed position for a further substantially fixed period. In FIG. 3 the movement of the valve member 26 from its closed to its open position coincides with the movement of the sleeve 29 from its open to its closed position and hence there is no delivery of fuel to the associated engine. In FIG. 4 the period during which the winding of the actuator remain energised has been extended so that the valve member 26 is in its closed position and remains in its closed position when and after the sleeve 29 has moved to its closed position. This means that there is a period during which both the valve member and sleeve are in their closed positions so that delivery of fuel for this period takes place to the associated engine. If the period of energisation of the winding is extended the maximum time period during which fuel can be supplied to the engine is determined by the sleeve and of course the period of energisation of the winding can be reduced until the setting shown in FIG. 3 is attained. It is therefore possible with this arrangement to utilise a single actuator to give any desired quantity of fuel from maximum to zero.

FIG. 2 shows another form of fuel system in which fuel is stored at high pressure in an accumulator chamber 40 and the valve is used to connect an injection nozzle shown at 41 with either the accumulator 40 or with a drain passage 42. The construction of the valve is substantially identical to the valve shown in FIG. 1 but in this case the valve member 26 controls the connection of the inlet of the nozzle 41 to the drain passage and the valve element or sleeve 29 controls the connection of the accumulator to the inlet of the nozzle. In the position shown in FIG. 2 which corresponds to the windings of the actuator being de-energised, the valve member 26 connects the inlet of the nozzle to the drain passage and the connection between the accumulator chamber and the inlet of the nozzle is interrupted by the sleeve 29. When the windings of the actuator are energised the valve member 26 moves into contact with its seating thereby interrupting the communication to the drain passage. After a predetermined time the sleeve 29 connects the accumulator chamber 40 to the inlet of the nozzle and delivery of fuel takes place to the associated engine. As in the previous example if the windings remain energised the sleeve 29 will eventually return to the blocking condition and this represents the maximum delivery of fuel to the engine. If however the windings of the actuator are de-energised so that the valve member 26 can lift from its seating then irrespective of the position of the sleeve 29 delivery of fuel to the associated engine will cease. If the sleeve has not returned to its initial closed position some flow of fuel will take place from the accumulator chamber to the passage 42. The flow of fuel through the nozzle can therefore be controlled down to zero.

Although as described a sleeve is utilised as the valve element, it is believed that this may be replaced by a seated valve moreover, the valves described require that the windings be energised in order to secure delivery of fuel. This arrangement is therefore "fail safe" in that if the supply of electric current should fail no fuel will be supplied to the engine. It is possible however to arrange that the windings should be energised to cut off the delivery of fuel.

We claim:

1. An electromagnetically operable valve including a valve member movable between first and second settings by an electromagnetic device having an output member which is coupled to the valve member, the electromagnetic device when supplied with electric current, moving the valve member from its first setting to its second setting against the action of biasing means which returns the valve member to its first setting when the flow of electric current is discontinued, the valve further including a valve element movable between first and second positions, the valve element moving under its inertia from its first position to its second position a predetermined time after and in response to the movement of the valve member to its second setting, the valve element returning towards its first position after a second predetermined time, said valve element comprising a sleeve slidably mounted in a bore and loosely mounted about a stem of the valve member, a spring being provided to bias the sleeve towards an abutment on said stem.

2. A valve according to claim 1 in which the valve member is shaped for engagement with a seating formed in an end wall of said bore, in the valve member being in its second setting when in engagement with the seating.

3. A valve according to claim 2, in which said sleeve is provided with a peripheral groove which is in constant communication with a first port formed in the wall of said bore and a second port formed in the wall of the bore for communication with said groove depending upon whether the sleeve is in its first or second setting.

4. A valve according to claim 1, in which said valve member and said valve element control first and second flow paths respectively through the valve.

5. A valve according to claim 4, in which said flow paths are closed when the valve member is in its second setting and the valve element is in its second position said flow paths being connected in parallel between the outlet of a high pressure fuel pump and a drain.

6. A valve according to claim 4, in which said first flow path is closed when the valve member is in its second setting and the second flow path is open when the valve element is in its second position, said first flow path being connected between the inlet of a fuel injection nozzle and a drain and the second flow path being connected between the inlet of the nozzle and an accumulator in which fuel is stored under pressure.

* * * * *